US008869903B2

(12) United States Patent
Thomas et al.

(10) Patent No.: US 8,869,903 B2
(45) Date of Patent: Oct. 28, 2014

(54) APPARATUS TO REMOTELY ACTUATE VALVES AND METHOD THEREOF

(75) Inventors: Anthony Thomas, Houston, TX (US); Kevin J. Berry, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 660 days.

(21) Appl. No.: 13/173,541

(22) Filed: Jun. 30, 2011

(65) Prior Publication Data

US 2013/0000921 A1 Jan. 3, 2013

(51) Int. Cl.
*E21B 34/12* (2006.01)
*E21B 43/14* (2006.01)
*E21B 34/14* (2006.01)

(52) U.S. Cl.
CPC ..... *E21B 43/14* (2013.01); *E21B 34/14* (2013.01)
USPC ..... 166/386; 166/177.5; 166/332.4; 166/334.4

(58) Field of Classification Search
CPC ..... E21B 34/14; E21B 34/12
USPC ..... 166/177.5, 308.1, 313, 332.4, 334.4, 166/369, 386
See application file for complete search history.

(56) References Cited

U.S. PATENT DOCUMENTS 4,658,904 A * 4/1987 Doremus et al. ..... 166/336
6,513,599 B1 2/2003 Bixenman et al.
7,458,420 B2 * 12/2008 Rioufol et al. ..... 166/250.01
7,543,647 B2 6/2009 Walker
7,712,538 B2 * 5/2010 Fay ..... 166/332.4
2001/0030049 A1 10/2001 Patel
2002/0166667 A1 11/2002 Patel et al.
2008/0141826 A1 6/2008 Marya et al.
2012/0325484 A1 * 12/2012 Patel ..... 166/308.2

OTHER PUBLICATIONS

Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].
Hinkie, Ron and Matt Howell. "Multi-Zone Completion With Accurately Placed Stimulation Through Casing Wall." Production and Operations Symposium, Mar. 31-Apr. 3, 2007, Oklahoma City, Oklahoma, U.S.A. [Abstract Only].
International Search Report and Written Opinion, Date of Mailing Jan. 10, 2013, International Application No. PCT/US2012/042707, Korean Intellectual Property Office, International Search Report 5 pages, Written Opinion 4 pages.

* cited by examiner

*Primary Examiner* — William P Neuder
*Assistant Examiner* — Richard Alker
(74) *Attorney, Agent, or Firm* — Cantor Colburn LLP

(57) ABSTRACT

A production string employable in a multi-zone completion system, the production string includes a passageway enabling passage of production fluids therethrough; a shifting tool including a shifting profile engageable with a production sleeve of the completion system to open a closed production sleeve, the shifting tool sharing the passageway of the production string; and, a remotely controlled hydraulic production valve which controls fluid flow between the passageway and the production sleeve. Also included is a production method useable in a borehole.

18 Claims, 9 Drawing Sheets

1 – Run string to final depth and space out

2 – Pickup string and install tubing hanger

3 – Lower string to depth

4 – Pickup string to a height allowing shifting tool to be placed above the longest interval and orient tubing hanger with landing string and BOP 5 – Activate shifting tools shifting MSV's on downstroke and land tubing hanger

APPARATUS TO REMOTELY ACTUATE VALVES AND METHOD THEREOF

BACKGROUND

The formation of wellbores for the purpose of exploration or extraction of natural resources such as oil, gas, and water is a valuable yet time consuming and expensive field. Completion of wellbores includes the process of making a well ready for production or injection. Some types of completion systems include a tubular which supports subs enabling a frac pack operation, isolation packing, and gravel pack operations, and production sleeves having screens for bringing production fluid from downhole to surface. Once wells are completed using this type of completion system, production tubing and associated downhole tools can be run into the wellbore.

Advances in completion technology have led to the emergence of multi-zone systems where zones within the formation are separated, such as by packers and sand control configurations and operations, and each zone can be separately treated, fractured, or produced from, which saves time and inevitably reduces expenses. A multi-zone single trip ("MST") completion system reduces time and expenses even further by completing multiple zones in one trip.

A multi-zone single trip ("MST") completion system is shown in FIGS. 1A and 1B. The MST system includes a number of subs attachable together to form a completion string 10. It should be understood that only a portion of the completion string 10 is shown, as the completion string 10 can include as many subs, tubing joints, and sleeves necessary for spanning as many zones as desired. As shown in FIG. 1A, the completion string 10 includes, in part, an automatic locating assembly or "autolocator" 12 to locate the completion string 10 in its various conditions such as, but not limited to pickup, run in, and set down positions. Inverted seals, which can include uphole and downhole inverted seals 14, 16, are provided within an inner diameter of the completion string 10 and are usable in a fracing operation. An isolation packer 18 is included in the completion string 10 and may include slips for engaging a casing or wellbore. The isolation packer 18 is located between the uphole inverted seals 14 and a frac sleeve 20. The frac sleeve 20 of the completion string 10 is located between the isolation packer 18 and downhole inverted seals 16.

The completion string 10 for multi-zone applications further includes multiple sets of the illustrated features which are spaced out with screen joints and production sleeves in between for production purposes, as shown in FIG. 1B. As shown in FIG. 1B, and downhole of the frac sleeve 20 and inverted seals 16, the MST system further includes shear out safety joint 24, production valves, also known as production sleeves 26 having a selective profile, that are capable of opening and closing depending on whether or not a particular zone should be opened for production, and a screen 28 extending along the length of the production zone. In one exemplary embodiment, a standard well is completed using a service string consisting of, but not limited to, a frac port, opening tool, and closing tool (not shown). Upon completion of the final zone, the service string may be removed from within the completion string 10. Upon removal, the closing tool on the service string closes all sleeves as it traverses through the completion string 10 in the uphole direction. Removal of the service tool leaves a bore 22 in the completion string 10 for receiving the production string. Production tubulars are then run into the wellbore and are connected to the completion string 10 enabling a continuous bore to surface. A separate opening/closing tool (not shown) can then be run in the completion string 10 for selectively opening and closing the production sleeves 26 to initiate production through the production string, where such determination may be made by an operator or by a sensing device, however this requires additional time since the opening/closing tool then needs to be removed from the completion string 10. Thus, production is initiated by selectively opening and/or closing selected production sleeves 26 using a work string such as by wireline, coiled or standard tubing. When multiple zones are accessed with the completion system 10, subsequent opening and/or closing of other selected production sleeves 26 requires additional runs of the work string.

BRIEF DESCRIPTION

A production string employable in a multi-zone completion system, the production string includes a passageway enabling passage of production fluids therethrough; a shifting tool including a shifting profile engageable with a production sleeve of the completion system to open a closed production sleeve, the shifting tool sharing the passageway of the production string; and, a remotely controlled hydraulic production valve which controls fluid flow between the passageway and the production sleeve.

A production method useable in a borehole, the method includes making up a production string with a shifting tool and hydraulic valve for one or more zones of a completion system, each shifting tool having a passageway of the production string; lowering the production string into the completion system; opening one or more production sleeves of the completion system using respective shifting tools of the production string; and, selectively opening desired hydraulic valves with control line pressure, wherein production from selected zones occurs between respective production sleeves and the passageway.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
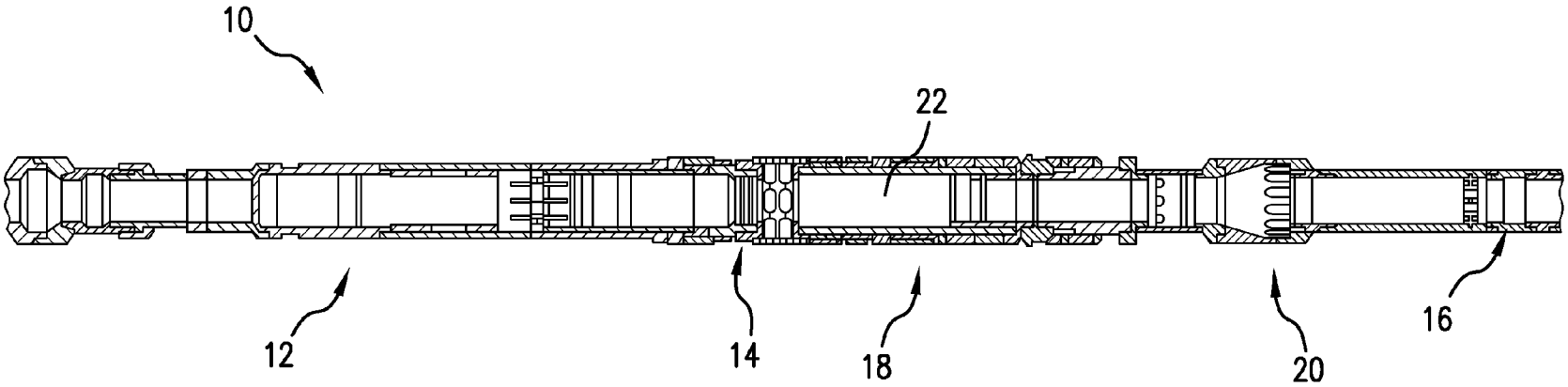
FIG. 1A PRIOR ART
FIGS. 1A and 1B depict cross sectional views of portions of a standard completion system of the prior art.

A detailed description of one or more embodiments of the disclosed apparatus and method are presented herein by way of exemplification and not limitation with reference to the Figures.

Minimizing the number of trips in a borehole operation reduces time, which can significantly reduce the completion and/or recovery cost. Exemplary embodiments of a system described herein include a production string 100 insertable into a completion system, such as the MST completion system shown in FIGS. 1A and 1B, the production string 100 including an integrated shifting tool 200 for opening and/or closing the production sleeves 26 of the completion system, thus eliminating the extra run of a work string to open and/or close the production sleeves 26. The production string 100 may include a plurality of zonal sections, such as Zonal Section 1 and Zonal Section 2 depicted in FIG. 7, where each zonal section includes, in part, a shifting tool 200 having a different shifting profile thereon, a slick joint 300, and a production valve 106.

Figure 2A:
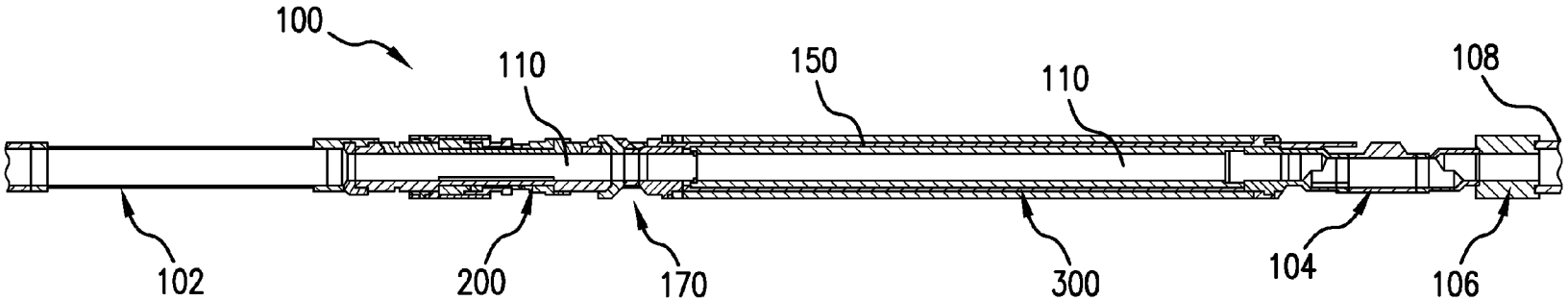
FIGS. 2A and 2B depict cross-sectional views of portions of an exemplary embodiment of a production string.
Figure 2B:
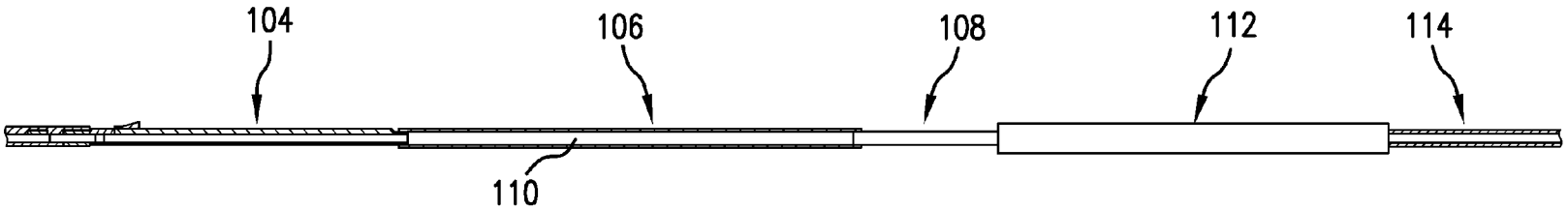

Turning now to FIG. 2A, a portion of an exemplary embodiment of a production string 100, which may be used in the completion string 10, is shown. For each completed zone, the exemplary production string 100 is made to include a zonal section having a pup joint 102 for ease of handling, a hydraulically activated feed-through shifting tool 200 with correct shifting profile for a corresponding production sleeve 26, a feed-through slick joint 300 connectable to the shifting tool 200 at non-rotatable connections 170 which align respective control line feed throughs, a gauge mandrel 104 for well monitoring purposes, a remotely operated hydraulic production valve 106, and a quick connect tool 108 for ease of make-up on rig floor, where the above-described devices may be so arranged from an uphole to downhole direction in each zonal section as shown. FIG. 2B further shows a section of blank pipe 112 and a sump packer 114 of the production string 100. The hydraulic production valve 106 remains closed until it is remotely operated to an open condition, such that even when all of the production sleeves 26 are opened, production does not begin until one or more of the production valves 106 are opened. In addition to each zone of production equipment, the production string 100 also includes a top packer (not shown) at an uphole end and anchor packer or sump packer 114 at a downhole end along with required production tubing or blank pipe 112. Each zonal section is appropriately spaced apart from other sections of the production string 100 for aligning with the zones in the formation and with the production sleeves 26 of the completion string 10. Standard production tubing or blank pipe 112 of appropriate lengths may separate adjacent zonal sections of the production string 100 as necessary. The pup joint 102, gauge mandrel 104, hydraulic production valve 106, and quick connect tool 108 may be standard components that are added to the production string 100 in a "plug and play" method on the rig floor, and therefore the details of these components are not further described. A series of hydraulic control lines 150 run the length of the production string 100 and enable the capability of permanent monitoring and selective operation of the hydraulic production valves 106 from the surface.

Figure 3A:
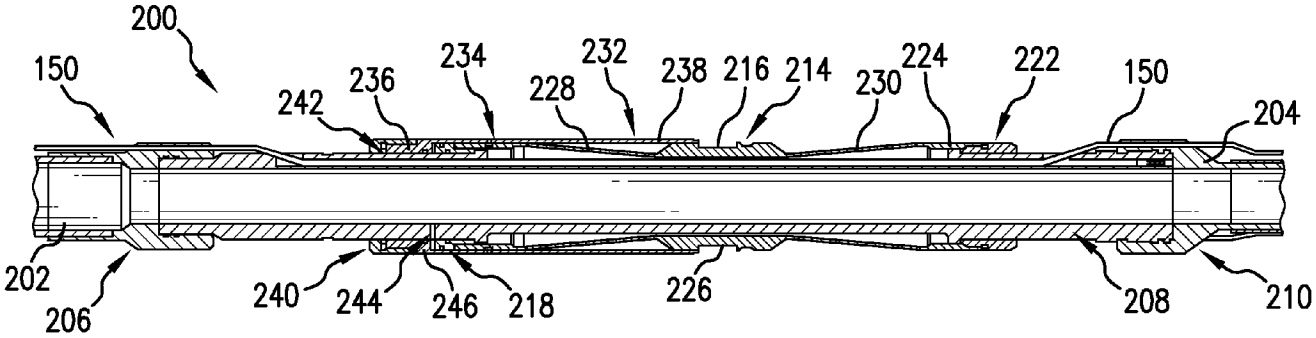
FIG. 3A depicts a cross-sectional view of an exemplary embodiment of a shifting tool in a crippled condition for the production string of FIGS. 2A and 2B.
Figure 3B:
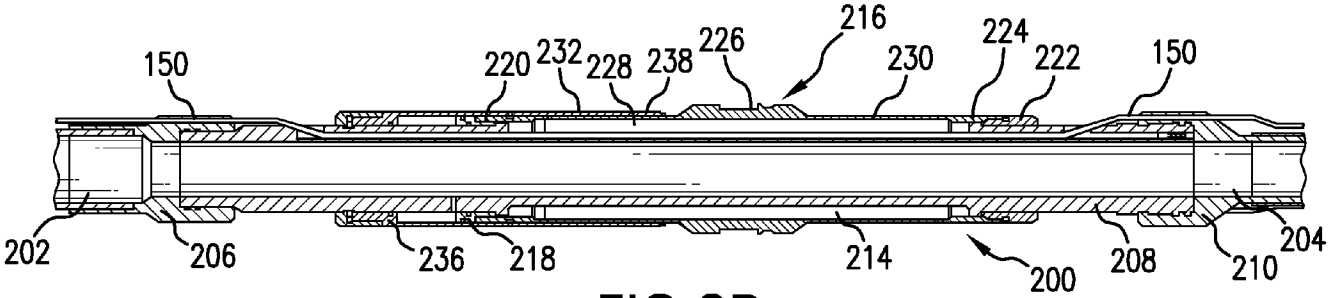
FIG. 3B depicts a cross-sectional view of the shifting tool of FIG. 3A in an activated condition.
Figure 3C:
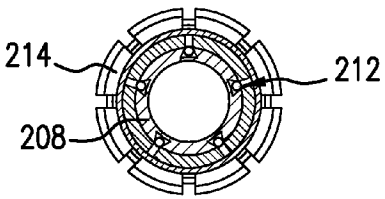
FIG. 3C depicts a cross-sectional view of the shifting tool of FIGS. 3A and 3B.

FIGS. 3A-3C show the hydraulically activated feed-through shifting tool 200. The shifting tool 200 includes a first end 202 and a second end 204. The first end 202 is typically an uphole end and the second end 204 is typically a downhole end, but the orientation may be reversed so long as the corresponding features on the completion string 10 coincide. The shifting tool 200 also includes a fluted first sub 206 and fluted second sub 208. The fluted second sub 208 is connected to an uphole end of a mandrel 210. The mandrel 210 includes slots machined therein, which are aligned with fluted slots on both the first sub 206 and the second sub 208. This alignment allows multiple control lines 150 to run through the shifting tool 200 so as to be protected therein. Thus, the geometry for control line bypass does not affect the functionality or ratings of the shifting tool 200. As shown in FIG. 3C, five control line feed-throughs 212 are shown. Since each control line 150 connects to a hydraulic production valve 106 of a zonal section of the production string 100, in the illustrated embodiment a total of up to five zonal sections of the production string 100 may be included, however the geometry for control line bypass may be altered to accommodate any number of control lines 150. Additionally, if five control line feed-throughs 212 are included, five or less zonal sections of the production string 100 may be provided.

A collet 214 having a specific shifting profile 216 is attached to first retaining nut 218 at a first end 220 of the collet 214 and second retaining nut 222 at a second end 224 of the collet 214. The collet 214 surrounds the second sub 208. In an exemplary embodiment, the shifting profile 216 for a particular zonal section of the production string 100 will only function for a corresponding production sleeve 26 of the completion string 10 (shown in FIG. 1B). The collet 214 includes a radially expandable section 226 that carries the shifting profile 216. The radially expandable section 226 is supported by a first collar 228 of the collet 214 between the radially expandable section 226 and the first retaining nut 218. The radially expandable section 226 is also supported by a second collar 230 of the collet 214 between the radially expandable section 226 and the second retaining nut 222. As shown in FIG. 3A, a crippling sleeve 232 is shear pinned via shear pin 234 to the first collar 228 and adjacent the first retaining nut 218 in the crippled condition of the shifting tool 200. In this crippled condition, a first end 236 of the crippling sleeve 232 is located uphole of the first collar 228 of the collet 214, and a second end 238 of the crippling sleeve 232 is located downhole of the first collar 228 and covering at least a portion of the expandable section 226, such that the expandable section 226 is forced radially inward as shown in FIG. 3A. Likewise, the downhole end of the first collar 228 and the uphole end of the second collar 230 are forced radially inward towards the second sub 208 in this crippled condition. The collet 214 is slotted to allow for the contraction and expansion of the expandable section 226. A port 244 in the second sub 208 connects a passageway 110 in the production string 100 to a closed inner space 246 formed between the crippling sleeve 232 and the second sub 208. As shown in FIG. 3B, internal pressure activation, via port 244, is used to push back the crippling sleeve 232 in a direction away from the collet 214 such that the second end 238 of the crippling sleeve 232 no longer rests on the expandable section 226, allowing the collet 214 to radially expand and push out its shifting profile 216 past an outer diameter of the crippling sleeve 232. When thus activated, a retaining cap 240 traps a lock ring 242 at the first end 236 of the crippling sleeve 232 to prevent the crippling sleeve 232 from sliding back over the expandable section 226 of the collet 214, such that the crippling feature of the shifting tool 200 is locked out and prevented from re-engaging with the shifting profile 216. Since hydraulic activation is required to activate the shifting tool 200, the shifting tool 200 remains disabled while running the production string 100 in the hole, thus preventing any premature opening of production sleeves 26. It should be noted that the crippling sleeve 232 can be oriented to face uphole or downhole depending on preference of the operator and well conditions. Thus, the terms uphole and downhole as used herein to describe the relative orientation of features of the shifting tool 200 and other components in the production string 100 and completion string 10 may be interchangeably used.

In an alternative exemplary embodiment, the shifting tool 200 may be run into the well without the hydraulic crippling feature 232 assembled thereto. This will reduce a cost of the shifting tool 200 and eliminate any risk of the shifting tool 200 becoming stuck in a crippled condition, while also eliminating the need to pressure down the tubing at any point in the operation to shear the crippling sleeve 232. Conversely, the operator will lose the ability to manipulate the shifting tool 200 within the well as many times as desired without the possibility of functioning a production sleeve.

Figure 4A:
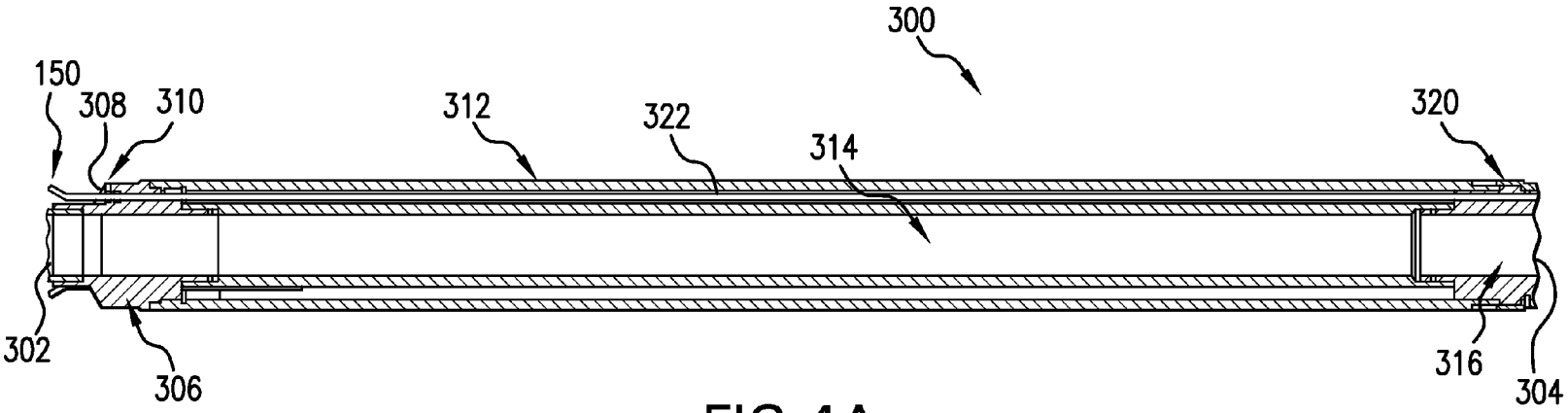
FIG. 4A depicts a cross-sectional view of an exemplary embodiment of a slick joint assembly.

FIG. 4A shows the feed-through slick joint assembly 300, which allows for zonal isolation. For example, if one zone begins producing water, an operator can close the associated hydraulic production valve 106 in that zone remotely and quickly. There is no need to make a run into the well and close it mechanically, which could take a full day or more depending on depth. Without the slick joint assembly 300 in each zone, the fluid from the zone producing water would flow into the annulus between the outer diameter of the production string 100 and an inner diameter of the completion string 10 and into the hydraulic production valves 106 of surrounding zones. The inclusion of the slick joint assembly 300 in the production string 100 blocks that flow from leaving the damaged zone.

Figure 4B:
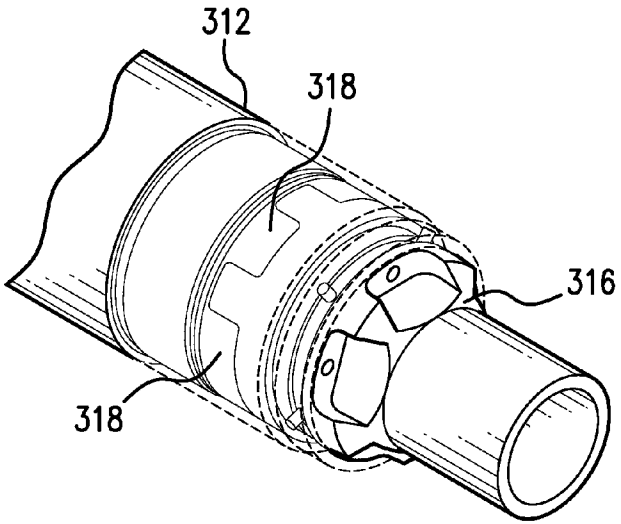
FIG. 4B depicts a perspective view of a portion of the slick joint assembly of FIG. 4A.
Figure 6:
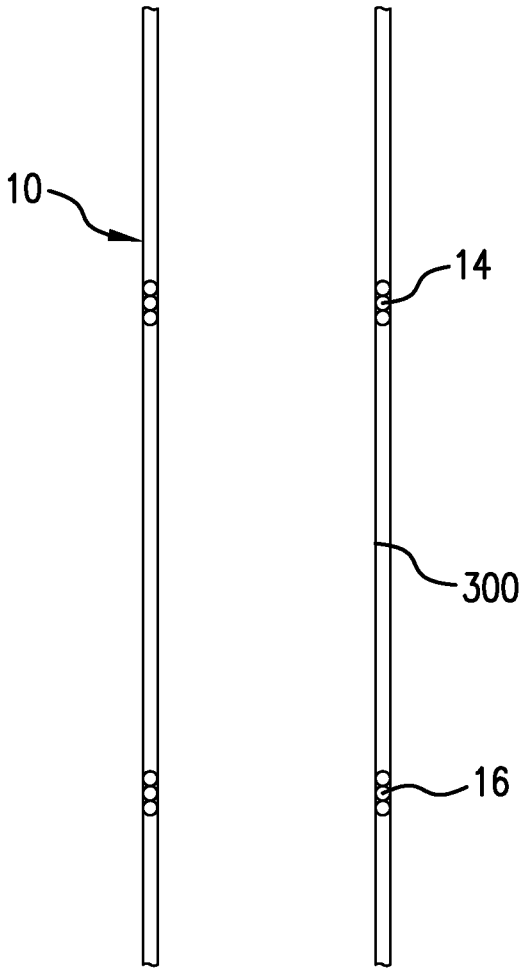
FIG. 6 depicts a schematic cross-sectional view of the slick joint within the completion system; and, FIG. 7 depicts the production string having a plurality of zonal sections.

The slick joint assembly 300 includes a first end 302, such as an uphole end, which is closer to the shifting tool 200, and a second end 304, such as a downhole end, which is closer to the hydraulic production valve 106. The slick joint assembly 300 is made up of a double pin first sub 306 which has threaded ports 308 to allow for externally pressure testable control line jam nut 310. The jam nut 310 may be a standard component that seals against the control lines 150, confirms pressure integrity of the control lines 150, and enables complete zonal isolation once the assembly is in place in the well. As with the shifting tool 200, the geometry for control line bypass in the slick joint 300 does not affect functionality or ratings of the slick joint 300. A smooth outer diameter slick mandrel 312 is joined to the first sub 306, such as via threading, and provides a place onto which the inverted seals 14, 16 can hold a pressure tight seal for zonal isolation, as shown in FIG. 6. An inner tubular 314 is also attached to the first sub 306 and provides a pressure tight path for production fluids to flow in the passageway 110 from the wellbore to surface after the hydraulic production valves 106 have been opened. The inner tubular 314 is capable of containing pressures expected during the production life of the well. With additional reference to FIG. 4B, a ported second sub 316, such as a downhole sub, connects with the inner tubular 314 and the slick mandrel 312. The second sub 316 may slide onto the inner tubular 314 while simultaneously sliding into fingers 318 on the slick mandrel 312. In such a configuration of a quick connect retaining feature, the second sub 316 requires no rotation during assembly so that control lines 150 can be plumbed first through feed throughs 322, thus making assembly of the production string 100 much simpler. The assembly of the slick joint 300 is then locked together with a retaining nut 320.

In an alternative exemplary embodiment, a minor modification to the slick joint 300 will allow the slick joint 300 to be run in conventional frac/gravel pack completions (either multi-zone or stack-pack). Instead of the slick joint 300 having a smooth outer diameter for sealing, the slick joint 300 may be re-configured to house traditional bonded seals which will then stab into existing seal bores already in place in the conventional frac/gravel pack completion. The slick joint 300 will then function as described above.

Figure 1B:
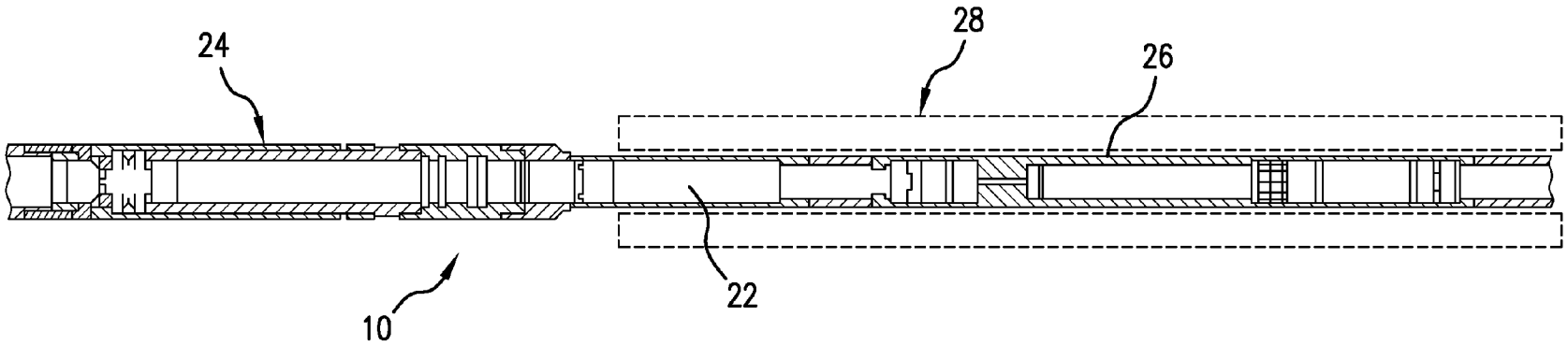
FIG. 1B PRIOR ART
Figure 5A:
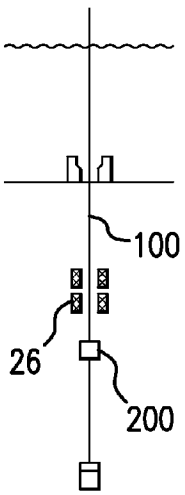
FIGS. 5A-5E depict a schematic view of an exemplary embodiment of an operation using the production string of FIGS. 2A and 2B.
Figure 5B:
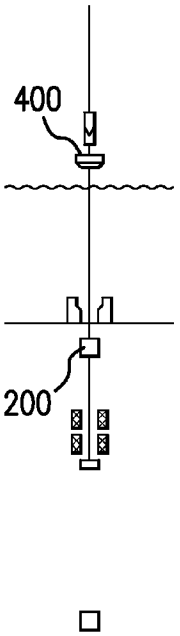
Figure 5C:
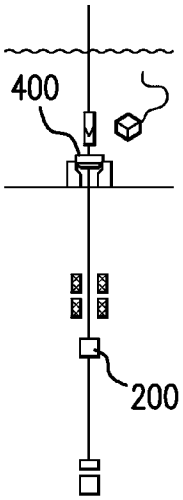
Figure 5D:
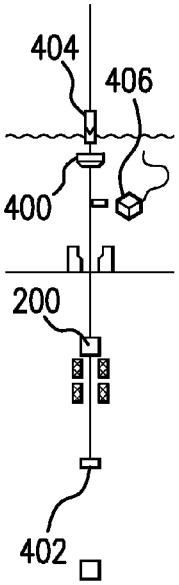
Figure 5E:
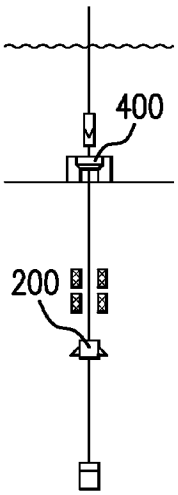
Figure 7:
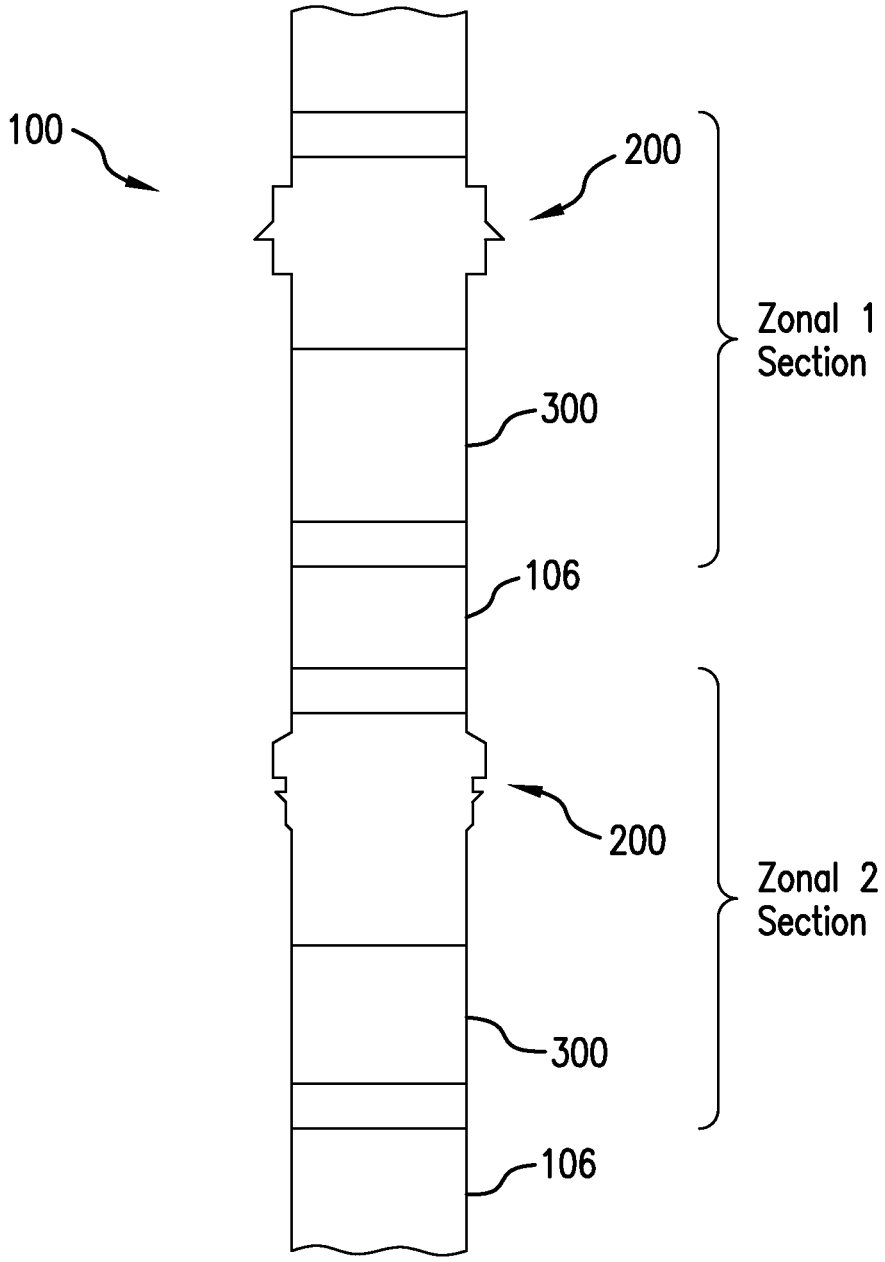

With reference to FIGS. 5A-5B, in operation, an operator will run an MST completion system, such as completion string 10 shown in FIGS. 1A and 1B, through a well. The well is then completed using a service tool (not shown). The service tool within the completion string 10 is then pulled from the well closing all of the production sleeves 26 on the completion string 10. A production string 100, such as shown in FIG. 2, is made up with enough tools for X number of zones, such as Zones 1 and 2 as shown in FIG. 7. As shown in FIG. 5A, the production string 100 is run to final depth and space out of the well while the shifting tools 200 are crippled as shown in FIG. 3A. The production string 100 is then picked up, as shown in FIG. 5B, and a tubing hanger 400 is installed, the production string 100 is again lowered to depth, as shown in FIG. 5C, and then picked up, as shown in FIG. 5D, to a height allowing the shifting tools 200 to be placed above (uphole of) the longest interval and the tubing hanger 400 is oriented with a landing string 402 and blowout preventer "BOP" 404. A remotely operated vehicle "ROV" 406 may be used to inspect, control, and/or manipulate these uphole portions. The shifting tools 200 are then activated by applying pressure down the tubing, such as via the passageway 110 of the production string 100 shown in FIG. 2A. The production string 100 is then lowered, as shown in FIG. 5E, opening all of the production sleeves 26 in the process via the shifting profiles 216 of the collets 214, as shown in FIG. 3B, and the tubing hanger 400 is landed. The slick joints 300, shown in FIG. 4A, will then be in place and sealed off on the existing inverted seals 14 or 16 as shown in FIG. 6, within the completion string 10 shown in FIG. 1A, isolating each zone. The anchor packer or sump packer 114 shown in FIG. 2B is set with control line pressure. Once the production sleeves 26 have been opened, the operator on surface can choose to open any hydraulic valve 106 shown in FIG. 2A desired with control line pressure from control lines 150 and production begins from selected zones while maintaining complete zonal isolation. Each hydraulic valve 106 has the capability of being turned on or off whenever desired. Should more than one hydraulic valve be opened at a time, then comingling of the production fluid may be allowed. As described above, in some situations, a multi-zone well may be completed with multiple flow paths for production fluids, where each flow path (tubular) leads to its own zone.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A production string employable in a multi-zone completion system, the production string comprising:

a passageway enabling passage of production fluids therethrough;

a shifting tool including a shifting profile engageable with a production sleeve of the completion system to open a closed production sleeve, the shifting tool including a plurality of control line feed-throughs passing between a collet containing the shifting profile and an inner tubular having a portion of the passageway of the production string;

a remotely controlled hydraulic production valve which controls fluid flow between the passageway and the production sleeve; and, a control line passing through one of the control line feed-throughs to the production valve.

2. The production string of claim 1, wherein the production string comprises a plurality of zonal sections, each zonal section including a shifting tool with a different shifting profile thereon.

3. The production string of claim 1, further comprising a slick joint and gauge mandrel interconnected between the shifting tool and hydraulic production valve.

4. The production string of claim 1, wherein the shifting tool includes an axially slidable crippling sleeve and the shifting profile is crippled in a first condition and activated in a second condition.

5. The production string of claim 4, wherein the crippling sleeve radially constricts the shifting profile in the first condition and allows radial expansion of the shifting profile in the second condition.

6. The production string of claim 1, further comprising a slick joint sealable within the completion system and having a portion of the passageway.

7. The production string of claim 1 comprising a plurality of zonal sections each including a shifting tool and hydraulic production valve.

8. The production string of claim 7, wherein each of the plurality of zonal sections further includes a slick joint having a portion of the passageway between the shifting tool and the hydraulic production valve.

9. The production string of claim 8, further comprising a control line feed through for each of the plurality of zonal sections passing between tubular sections of the shifting tool, and between tubular sections of the slick joint, the control line feed throughs supporting control lines for the hydraulic production valves of the plurality of zonal sections.

10. The production string of claim 9, wherein the shifting tool and slick joint are axially connected to align the respective control line feed throughs.

11. A production string employable in a multi-zone completion system, the production string comprising:

a passageway enabling passage of production fluids therethrough;

a shifting tool including a shifting profile engageable with a production sleeve of the completion system to open a closed production sleeve, the shifting tool having a portion of the passageway of the production string, the shifting profile crippled in a first condition and activated in a second condition by an axially slidable crippling sleeve, the crippling sleeve shear pinned to a collet containing the shifting profile in the first condition; and, a remotely controlled hydraulic production valve which controls fluid flow between the passageway and the production sleeve.

12. The production string of claim 11, wherein the crippling sleeve is movable by internal pressure activation via a port connecting the passageway and a space surrounded in part by the crippling sleeve.

13. A production string employable in a multi-zone completion system, the production string comprising:

a passageway enabling passage of production fluids therethrough;

a shifting tool including a shifting profile engageable with a production sleeve of the completion system to open a closed production sleeve, the shifting tool having a portion of the passageway of the production string;

a remotely controlled hydraulic production valve which controls fluid flow between the passageway and the production sleeve; and, a slick joint sealable within the completion system and having a portion of the passageway, and wherein the slick joint includes a plurality of control line feed-throughs for corresponding zones, the feed-throughs passing between an outer slick mandrel and an inner tubular of the slick joint.

14. A production string employable in a multi-zone completion system, the production string comprising:

a passageway enabling passage of production fluids therethrough;

a shifting tool including a shifting profile engageable with a production sleeve of the completion system to open a closed production sleeve, the shifting tool having a portion of the passageway of the production string;

a remotely controlled hydraulic production valve which controls fluid flow between the passageway and the production sleeve; and, a slick joint sealable within the completion system and having a portion of the passageway, and fingers extending from an end of the slick joint, the fingers axially connecting the slick joint to an adjacent sub.

15. A production method useable in a borehole, the method comprising:

employing the production string of claim 1 for one or more zones of a completion system;

lowering the production string into the completion system;

opening one or more production sleeves of the completion system using respective shifting tools of the production string; and, selectively opening desired hydraulic valves with control line pressure, wherein production from selected zones occurs between respective production sleeves and the passageway.

16. The production method of claim 15, wherein opening one or more production sleeves includes opening at least two of the one or more production sleeves substantially simultaneously.

17. The production method of claim 15, further comprising activating a crippled shifting profile by revealing a radially expandable section on one or more respective shifting tools subsequent lowering the production string into the completion system.

18. The production method of claim 15, further comprising providing zonal isolation by sealing a slick joint on an inverted seal of the completion system, the slick joint having a portion of the passageway.

* * * * *